US005347250A

United States Patent [19]

Muske

[11] Patent Number: 5,347,250

[45] Date of Patent: Sep. 13, 1994

[54] ELECTROMAGNETIC SWITCHING DEVICE

[75] Inventor: Markus Muske, Lohmar, Fed. Rep. of Germany

[73] Assignee: Klochner-Moeller Elektrizitats GmbH, Bonn, Fed. Rep. of Germany

[21] Appl. No.: 582,864

[22] PCT Filed: May 13, 1989

[86] PCT No.: PCT/EP89/00526

§ 371 Date: Apr. 8, 1991

§ 102(e) Date: Apr. 8, 1991

[87] PCT Pub. No.: WO89/11726

PCT Pub. Date: Nov. 30, 1989

[30] Foreign Application Priority Data

May 19, 1988 [DE] Fed. Rep. of Germany ..... 3817002

[51] Int. Cl.[5] ..... H01H 67/02

[52] U.S. Cl. ..... 335/132; 335/202

[58] Field of Search ..... 335/131, 132, 202

[56] References Cited

U.S. PATENT DOCUMENTS

| | | | |
|---|---|---|---|
| 4,899,120 | 2/1990 | Ohtake et al. | 335/202 |
| 4,951,018 | 8/1990 | Schmiedel et al. | 335/132 |
| 5,012,215 | 4/1991 | Floc'h | 335/132 |

*Primary Examiner*—Lincoln Donovan

*Attorney, Agent, or Firm*—Antonelli, Terry, Stout & Kraus

[57] ABSTRACT

An electromagnetic switching device comprises a housing containing a switch contact space and connection contact space, and a driving space formed by a basic body in which the magnet and coil are lodged. The parts of the connection contacts and coil connections of the pre-assembled contact carrier with return spring and of a switch space cover with an insertion device that can be releasably fastened to said cover, which are to be accommodated in the housing, are assembled in succession from a direction perpendicular to the sliding direction of the contact carrier and retained by interlocking connections.

20 Claims, 3 Drawing Sheets

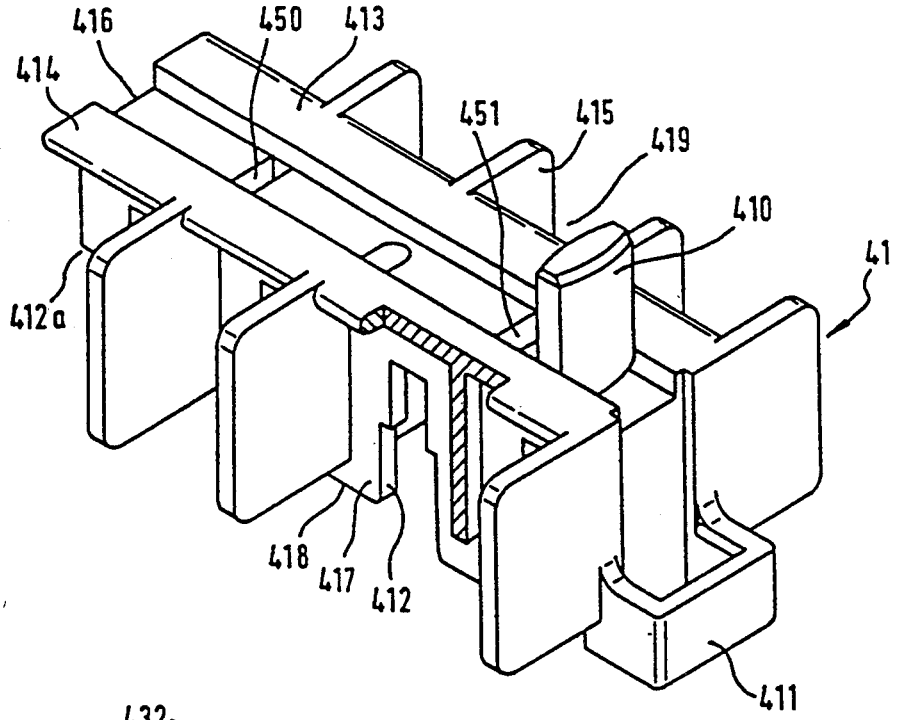
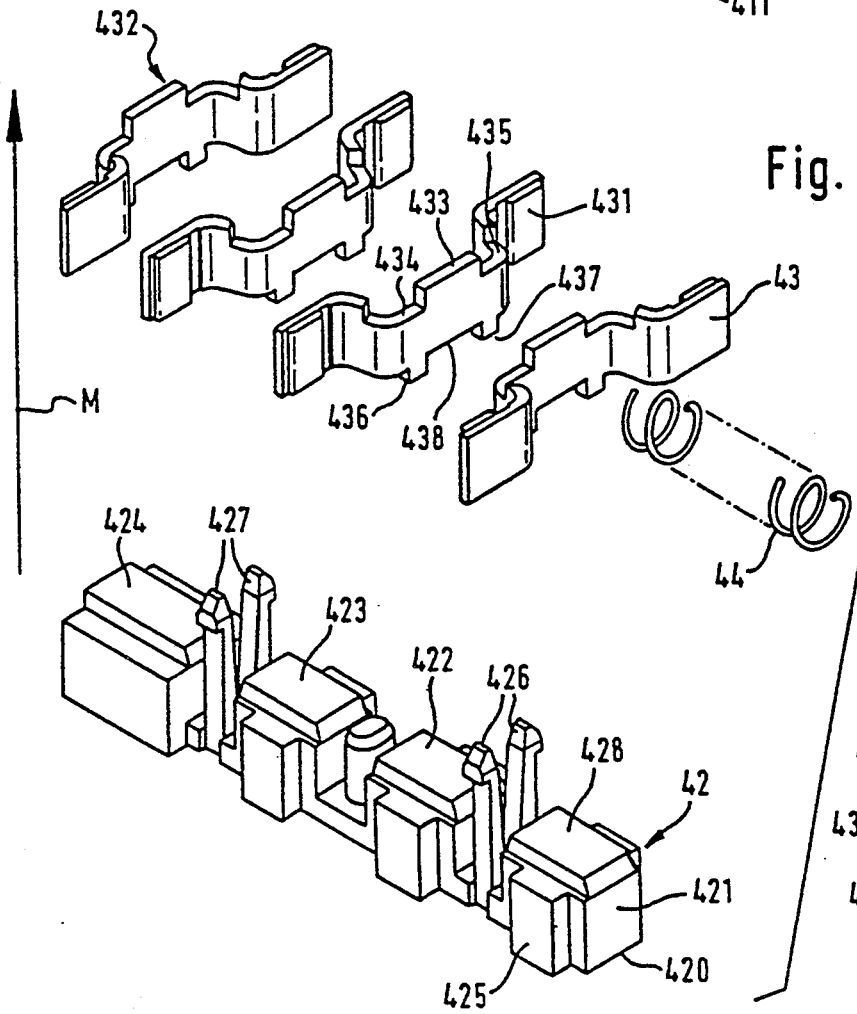
Fig. 2
Fig. 3
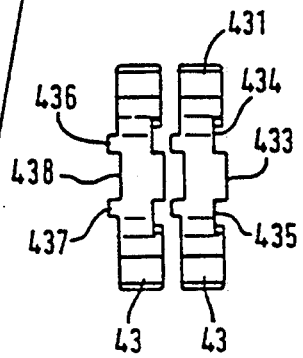

ELECTROMAGNETIC SWITCHING DEVICE

The invention relates to an electromagnetic switching device with a drive space accommodating the magnet and the coil and formed by a base member, this drive space being connected in shape-mating fashion with a housing containing a switch contact space and connection contact spaces, this housing accommodating a contact support displaceable against a return spring with positively guided, movable bridge contacts attached by way of contact pressure springs, and the associated, fixed connecting contacts.

Three-phase contactors with induction coil switching in an air space are utilized with great versatility as power protection devices and auxiliary contactors; in these arrangements, the basic units can be completed and/or varied by further components in a module system.

It is known to combine the individual structural parts of a contactor relay into component groups and preassemble same to permit a maximally economical manufacture. The connecting of the individual components normally is brought about by shape-mating connections, optionally also by force-derived connections.

The invention is based on the object of making it possible to assemble the components and component groups of a switching device by means of automatic manufacturing machines.

This object has been attained, for the housing of an electromagnetic switching device containing the switch contact space and the connecting contact spaces in accordance with the preamble, by providing an arrangement in such a way that the parts of the connecting contacts and coil terminals, of the preassembled contact support with return spring, and of a switch space cover with an insertion means releasably attachable to the switch space cover, to be accommodated by the housing, are assembled in succession from only one direction (M) extending perpendicularly to the shifting direction (S) of the contact support, and are retained by means of interlocking connections. Thus, in accordance with the invention, the arrangements effecting the interlocking connections and the external configuration are fashioned in all participating structural parts so that all parts not serving for transmitting the power between drive means and contact bridge and being independent of the respective power system, ac or dc drive, can be mounted linearly from only one direction.

In a further development of the invention, the provision is made that, in each of the four current paths of the contact, it is possible to realize selectively make contacts or break contacts with the same structural parts. Suitable embodiments of the contact support, the bridge contacts, and the contact pressure springs can be derived from the features of claims 2–6. According to the invention, it is also possible to mount the contact support with the contact arrangement likewise by means of automatic manufacturing machines linearly from one direction. For the selective design as a make or break contact, the bridge contact is preferably fashioned to be offset so that, by reversal and/or a mirror-image arrangement, the alternate contacts can be realized at differing spring pressures.

An advantageous embodiment of the housing accommodating the switch contact space and the connecting contact spaces, in a tank-shaped configuration open toward the top, can be derived from the characterizing features of claim 7. All of the required components can be inserted linearly from above into the housing in succession; in this arrangement, they are fixed in place either by a shape-mating connection, such as locked-in-place connections, clip-on connections, snap-on connections, and plug-in connections, and/or in a force-derived fashion.

Due to the design of the housing in accordance with the characterizing features of claim 8, a guide groove is created on the bottom of the housing in the switch contact space wherein the inserted contact support is displaceably guided. Moreover, the contact support is equipped on its oppositely located topside with a parallel-extending groove engaged by a web of the switch space cover, this web forming the second guide means for the contact support.

In accordance with a preferred embodiment of the contact support, all of the guide surfaces of the contact support in opposition to the switch space cover and, respectively, the housing, such as grooves and webs, are located on the top part of the contact support. This is made possible, for example, by providing that the top part of the contact support exhibits walls projecting downwardly past the inserted bottom part, the top part engaging between the transverse webs on the housing bottom by means of these walls.

An especially advantageous embodiment of the contact support according to the features of claim 19 permits a highly compact arrangement of the return spring for the contact support with a simultaneously large installation length thereof, i.e. a long spring stroke can be obtained within a minimum amount of space.

Furthermore, the housing is equipped, in accordance with this invention, as set forth in the characterizing features of claims 9 and 10 in order to perfectly position, in particular, the switch space cover with the guide means for the contact support and to fix it in place by means of an interlocking connection.

In order to be able to locate the housing containing the switch contacts with an adequate voltage interval to a directly adjacent neighboring switching device, projecting webs are formed at the housing on the underside in the zone of the sidewalls at an appropriate level.

For providing a simple and flawless assembly and mounting of the connecting contacts, a further development of the invention includes the feature that the contact bases of the connections exhibit barb-like extensions, by means of which they are retained in a force-locking and shape-mating fashion in the connecting spaces of the housing by being pressed into the adjoining walls.

A preferred, advantageous embodiment of the switch space cover according to this invention can be seen from the characterizing features of claims 13 and 14. The switch space cover can thus be locked in place with a clip-on action onto and/or into the switch contact space from above at the housing. Moreover, the switch space cover is equipped with recesses so that additional components, such as, for example, an auxiliary switch module or a locking module, can interlock by means of snap-in hooks or the like.

To prevent improper versions of auxiliary switch modules from being clipped onto the switching device, the provision is made that the switch space cover exhibits a coding unit on its topside. This coding unit can exhibit a varying shape in correspondence with the components to be attached.

In a further embodiment of the housing for automatic assembly, the provision is made that the insertion means can be releasably clamped in place on the switch space cover by means of snap pins. The snap pins of the insertion aid are shaped so that the latter can be dismounted at any time, i.e. is removable from the switch space cover.

The construction of the contact arrangement of an electromagnetic switching device proposed by the present invention makes it possible to mount the contact arrangement as well as the housing accommodating the contacts in a simple way by means of automatic manufacturing machines wherein the same structural parts can be employed for various applications with differing contact patterns—make contacts—break contacts.

Further details and advantages of the invention will be described with reference to an embodiment illustrated in the drawings wherein:

FIG. 2 shows an isometric representation of the parts of the contact support, FIG. 3 shows a top view of the bridge contacts.

Figure 1:
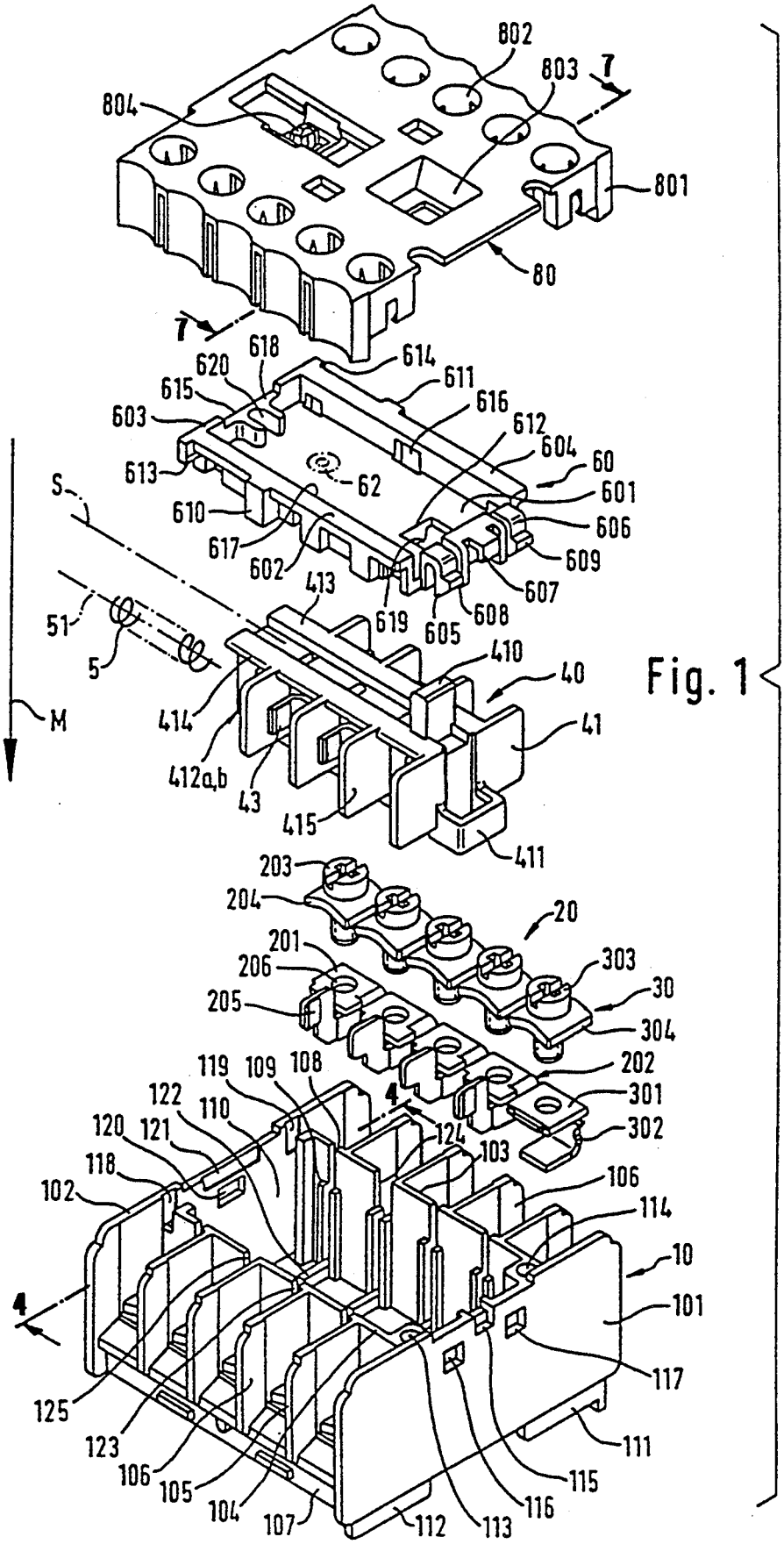
FIG. 1 shows an isometric representation of the housing containing the contacts.

In FIG. 1, the housing 10 of an electromagnetic switching device, comprising the switch contact space 110 and connecting contact spaces 106 including the associated structural parts, is illustrated wherein the drive space of the electromagnetic switching device with the electromagnetic drive mechanism has not been included in the illustration.

The complete device containing the switching contacts and the connecting contacts conprises, according to FIG. 1, the individual structural parts of the housing 10 of the connecting contacts 20 and coil connections 30, the complete preassembled contact bridge, also denoted as contact support 40, with return spring 5, the switch space cover 60, and an insertion means 80.

Figure 4:
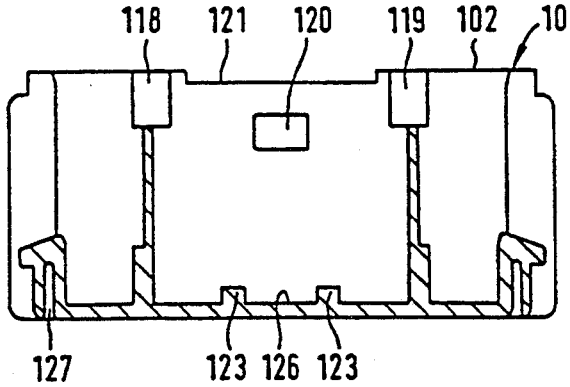
FIG. 4 shows a section AA through the housing according to FIG. 1.

The switch housing 10 is subdivided by walls in such a way that it exhibits the upwardly open central switch space 110 and the connecting spaces 106 arranged on both sides and being open toward the top and sides. On two mutually opposed sides, the sidewalls 101, 102 are equipped with the bottom part 107. The sidewalls are joined by the transverse walls 103, 104, wherein the transverse walls define the central switch space 110 in the middle zone. The partitions 105 emanate from the transverse walls toward the outside in parallel to the sidewalls; these partitions form the compartments for the connecting spaces 106, five on each side. Of these connecting spaces, respectively four are provided for the current paths, and the fifth is provided for the coil connections. These are identical. In the region of each connecting space 106, the transverse wall is formed with a perpendicularly extending slot 108 passing through from the top toward the bottom; the connecting contacts are extended through this slot. On both sides of the slots 108, parallel-extending, projecting ribs or webs 109 are formed on the transverse wall, facing the switch space 110 but terminating below the top edge of the transverse walls 103,104. These upper shoulders of the ribs 109 serve as supporting surfaces for the switch space cover 60 to be placed thereon at a later point in time. Supporting ribs 122 are likewise formed on the bottom 107, starting with the slots 108 of the transverse walls; these supporting ribs extend toward the middle of the switch space and terminate in transverse ribs 123, thus forming between them the open groove 126, see FIG. 4. This groove 126 serves for the insertion and guidance of the contact support 40 with corresponding guide means projecting on the underside of the top part 41, whereby the contact support 40 is securely centered and guided on the bottom within the housing 10.

Webs 111, 112 are formed on the underside of the housing 10 in the lateral zone; these webs ensure an adequate voltage interval with respect to a directly adjoining, neighboring switching device. Along the longitudinal sides, insert grooves 127 can be formed which are open toward the underside.

In the transition of the transverse walls 103, 104 to the sidewall 101, thickened portions are provided in the direction of the switch space 110 and exhibit centering bores 113, 114. Extensions, for example plugs of auxiliary switch modules, can be introduced into these centering bores so that these modules can be clipped onto the housing without any play. The switch space cover 60 is fashioned so that the centering bores 113, 114 are left vacant toward the top. In the transition of the transverse walls 103,104 to the oppositely located sidewall 102, detent grooves 118, 119 are formed, starting from the top, in the transverse walls; the switch space cover, with corresponding projecting webs, can be inserted in these grooves with true fit. Since the switch space cover 60 must be inserted in shape-mating and force-derived connection with the housing 10 covering the switch space 110 and centering the contact support 40, the sidewalls 101, 102 of the housing are formed with additional recesses and perforations as parts of an interlocking connection, fitting with the switch space cover 60. For example, the provision is made to arrange on the sidewall 101 in the upper central zone, adjoining the switch space 110, two perforations 116, 117 in a symmetrical fashion; snap hooks of the switch space cover can lock into these perforations from the switch space side. Also, the recess 115, accessible from the top, is provided in the sidewall 101 on the outside in a central position on the top edge. In the sidewall 102, the perforation 120 can be arranged centrally in the upper region likewise for the introduction of an extension or projection of the switch space cover, and, moreover, a recess 121 can be located on the top edge on the inside, facing the switch space 110, as a support shelf or guide means. The recess 121 can also be designed to be staggered.

Moreover, the housing 10 can be formed with a further accurately fitted plug-in guide for the switch space cover 60 in such a way that, for example, in the region of the transverse walls 103,104, in the zone of the slots 108, one of these slots 108 is designed to be wider above the ribs 109 formed thereat, and thus is a broad insertion groove for corresponding projections 610, 611 arranged laterally of the switch space cover 60.

Figure 5:
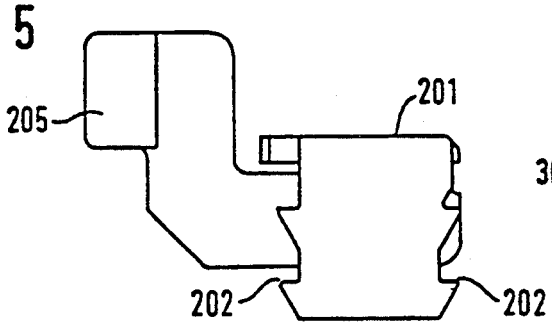
FIG. 5 shows a lateral view of a connecting contact piece.
Figure 6:
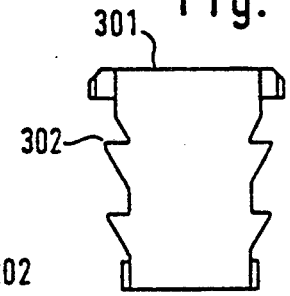
FIG. 6 shows a front view of a coil connection.
Figure 7:
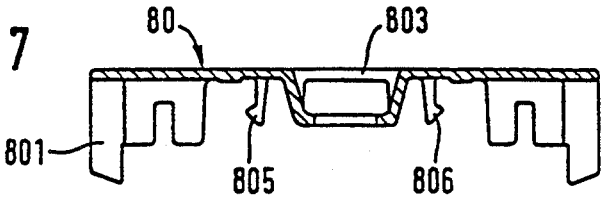
FIG. 7 shows a section BB through the insertion means of FIG. 1.

The housing 10 is designed so that all components to be inserted can be introduced from above from one direction, see part M, in succession. Accordingly, the assembly by means of automatic manufacturing machines is made possible. First of all, the terminals 20, 30 for the connecting contacts and the coils are inserted in the connecting spaces 106. These terminals 20 and 30, respectively, contain the U-shaped base 201, 301. In this arrangement, the base 201 is equipped with the connection contact lugs 205. The bases 201 and 301, respectively, can possess threaded passages for screw mounting or alternatively welded-on flat plug-in lugs. All connections are associated with the clamping screws 203 and 303, with clamping disks 204, 304. The coil connections 30 are of identical structure. In order to fix the connections 20, 30 permanently in place in the connection spaces 106, their bases 201, 301 are laterally formed with barb-like extensions 202 and 302, respectively, see the views of FIGS. 5 and 6; with these extensions, they are inserted in the connection spaces 106 in a force-derived and shape-mating connection. The connecting contacts can selectively be threaded, flat plug-in, insertion, and printed or welded terminals.

After the connection spaces 106 have been supplied, the premounted contact support 40, studded with the bridge contacts 43, is inserted with the return spring 5 in the switch contact space 110 of the housing 10. The spring axis 51 here extends in parallel to the bottom of the housing, and the contact support can be displaced with forced guidance against the pressure of the spring 5 in the switch contact space 110. The return spring is in this arrangement accommodated in a recess 412*a* of the contact support top portion 41, arranged beneath the bridge contacts 43. The contact support 40 is moved by way of a lever, not shown, by the electromagnet of the electromagnetic drive means, not illustrated, the latter engaging into the opening formed by the strap 411. The contact support 40 is guided on the underside in the groove 126 defined by webs 123 on the bottom 107 of the switch contact space 110.

The switch contact space and the inserted contact support 40 are covered by means of the switch space cover 60 clipped onto the housing 10. The switch space cover 60 exhibits the lid wall 601 surrounded along three sides continuously by upwardly protruding marginal webs 602, 603, 604. On the side coming into engagement at the two sides 101, 102 of the housing, the switch space cover is designed with corresponding snap hooks and projections forming, together with the perforations and recesses of the housing sidewalls, shape-mating plug-in and snap connections. In particular, the hook-shaped projecting extension 607 is centrally formed on the side of the switch space cover facing the sidewall 101 of the housing; this extension fits into the recess 115. Also, the projecting, resilient snap hooks 605, 606 are provided laterally; these are of a U-shaped configuration and are designed with the barbs 608,609. These snap hooks engage from the inside, i.e. from the switch contact space, into the perforations 116, 117 of the housing. It is also possible only to provide the two lateral snap hooks 605, 606 and to omit the central hook 607. On the opposite side, a projection 615, also called a detent, is centrally formed on the switch space cover 60, engaging from the inside into the perforation 120. Additionally, guidance of the switch space cover 60 is provided in the insert grooves 118, 119 of the housing on account of the webs 613, 614 formed by a milled-out zone on the underside of the web 602 of the switch space cover 60.

Furthermore, the switch space cover is provided on its topside with the insert groove 620 formed as a snap-in groove by means of the bilateral spring legs. Further, the switch space cover 60 is fashioned with undercut grooves 616, 617 and/or with recesses into which barbs or snap hooks of further components can come into engagement, such as, for example, a module for the mechanical locking of the unit or an auxiliary switch module. In the zone of the switching cam 410 of the contact support 40, the switch space cover is fashioned with a corresponding pass-through opening 612. In this arrangement, the guide rib 619 can be seen, formed on the underside of the switch space cover 60 and fitting into a corresponding groove 416 on the topside of the contact carrier 40. The switch space cover 60 is designed with recessed corners on the side at the wall 101 of the housing 10 where the centering bores 113, 114 for additional components to be attached are provided.

Furthermore, the switch space cover 60 is fashioned on the topside at a suitable location with the coding unit 62, for example a projecting cam, a protruding ring, cross, or the like. The coding unit can have varying configurations so that in each case only the corresponding version of an auxiliary switch module can be clipped on, which fits correspondingly onto the provided coding unit 62.

Moreover, the insert aid 80 is provided which covers the topside of the housing 10 and which is releasably clamped in place by means of snap hooks 805, 806 in recesses of the marginal webs 602, 604 of the switch space cover. The insert means 80 likewise has, in the lid zone, the pass-through opening 803 for the switching cam and also has a recess corresponding to the coding unit 62. Moreover, the insert means is equipped with connecting bores 802 corresponding to the connections. In parallel to the connecting bores 802, the insert means 80 has the projecting marginal webs 801 along the external sides. On the underside of the insert means 80, the snap hooks 805, 806 are formed which clip into recesses of the switch space cover but are of such a shape that the insert aid can again be dismounted at any time.

Figure 8:
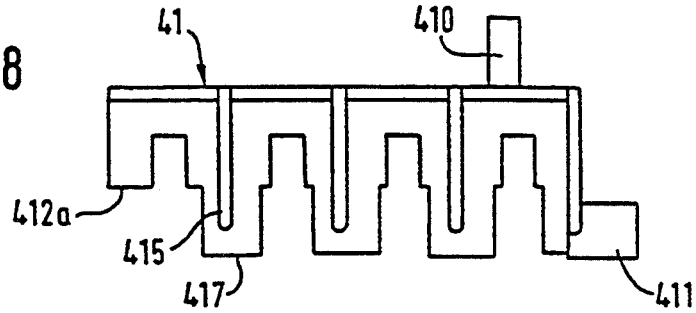
FIGS. 8 and 9 show two views of the top part of the contact support according to FIG. 2.
Figure 9:
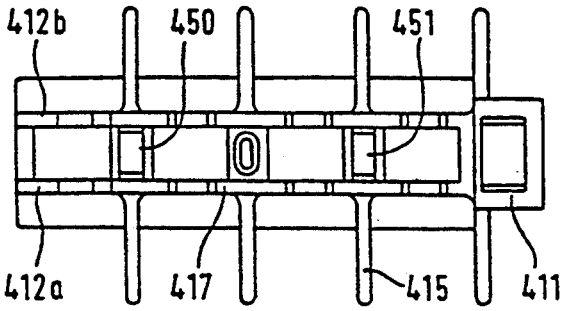

FIG. 2 illustrates in an isometric representation the contact carrier 40 with its individual structural parts, composed in the direction of arrow M linearly in one direction. Also this contact support can be mounted by means of manufacturing automats. It is also possible to mount, on the same automatic manufacturing machine, in succession the contact support and the complete housing. The contact support 40 consists of the top part 41, the bridge contacts 43 with contact pressure springs 44, each bridge contact being associated with a contact pressure spring 44 (only one is illustrated), and the bottom part 42. The top part 41 exhibits, in the lid zone 413, 414, the guide groove 416 and the protruding switching cam 410. On one end face, the projecting strap 411 is formed for engagement of the switching lever, see also FIGS. 8 and 9. The top part likewise exhibits walls 417 projecting in the downward direction and extending in the longitudinal direction; these walls form between them the housing for the contact pressure springs 44, inter alia. The top part furthermore comprises the sidewalls 415 extending perpendicularly thereto, the contact chambers 419 being partitioned off therebetween. The longitudinal walls 417 are formed in each contact chamber 419 with a stepwise offset insert opening 412, see the drawn detail in the top part 41 of FIG. 2. Moreover, the longitudinal walls on the side in opposition to the insert strap 411 are likewise shortened by the shoulder 412*a, b*, see also the bottom view of the top part according to FIG. 9. The bridge contacts 43 and the contact pressure springs 44 are inserted from below in the top part 41 and fixed in place by attaching and locking the bottom part 42 with the locking hook pairs 426, 427 in the detent grooves 450, 451 of the top part 41.

The bridge contacts 43 are of such a shape that they are usable as break contacts as well as make contacts; they need merely be reversed by 180° in the plane, see the various arrangements according to FIG. 2. The bridge contacts 43, see also the additional top view of FIG. 3, are of strip-shaped structure and exhibit a central U-shaped bend 432. The contact surfaces 431 are provided on the laterally projecting bridge ends; these surfaces point into the same direction as the bend. Moreover, the bridge contacts are formed on the topside and underside with a respectively congruent recess 438 or projection 433, as well as with laterally adjoining webs 436, 437 and recesses 434, 435. The bridge contacts exhibit such a shape that they can be punched out without interspaces with respect to the next bridge contact from an endless strip.

The bottom part 42 exhibits a continuous bottom surface 420 from which four turrets 421, 422, 423, 424 extend which engage into the open spaces between the longitudinal walls of the top part and serve for fixation of the contact pressure springs 44 and of the bridge contacts 43 in the top part. Furthermore, the bottom part 42 has, for example, 2 pairs of projecting, resilient detent hook pairs 426, 427; by means of the latter, the bottom part locks with shape-mating connection into corresponding detent grooves of the top part.

The turrets of the bottom part 42 exhibit lateral projections 425 which fit into the broadened recesses 412 of the top part.

The preassembled contact support 40, composed of the parts according to FIG. 2, is then inserted in the housing 10 in the switch contact space 110 as explained in the description of FIG. 1.

I claim:

1. Electromagnetic switching device with a drive space accommodating a magnet and a coil and formed by a base member, said drive space being connected in a shape-mating fashion with a housing containing a switch contact space and connection contact spaces, said housing accommodating a contact support displaceable against a return spring with positively guided, movable bridge contacts attached by way of contact pressure springs, and with related, fixed connecting contacts, characterized in that parts of the device comprising connecting contacts and coil terminals, a contact support with return spring, and a switch space cover, and an insertion means releasably attached to the switch space cover, to be accommodated by the housing, are assembled in succession from only one direction (M) extending perpendicularly to a shifting direction (S) of the contact support, and are retained by means of interlocking connections.

2. Switching device according to claim 1, characterized in that the contact support is preassembled and comprises a top part with wall webs projecting at both sides and partitioning off the contact chambers, and bridge contacts which are inserted in the top part from only one direction (M) perpendicular to the shifting direction (S) of the contact support, contact pressure springs, and a bottom part.

3. Switching device according to claim 2, characterized in that the bridge contacts are strip-shaped and are provided with a central U-shaped bend and are inserted, by reversal by 180°, selectively as break contacts or make contacts.

4. Switching device according to claim 3, characterized in that contact surfaces are formed on the side of the bridge contacts where the U-shaped bend projects.

5. Switching device according to claim 3, characterized in that the bridge contacts exhibit, in a central zone of the U-shaped bend, an upwardly projecting extension and, on an underside, a recess congruent therewith.

6. Switching device according to claim 2, characterized in that a contact pressure spring, associated with each bridge contact, is identical for the function as a break contact or make contact, wherein differing contact pressure forces can be attained for the function as break and, respectively, make contact by differing installation lengths in the top part.

7. Switching device according to claim 1, characterized in that the housing opens upwardly and exhibits two mutually parallel sidewalls, connected by two transverse walls defining a central switching chamber, partitioning walls emanating from these transverse walls which extend in parallel to the sidewalls and run toward the outside to a housing edge, subdividing individual connection spaces, wherein the transverse walls exhibit, associated with each connection space, a slot continuously extending from the top, and wherein, on the side facing the switching chamber, projecting webs are formed on the transverse walls bilaterally of the slots, these webs terminating at a spacing below the top edge of the transverse walls.

8. Switching device according to claim 7, characterized in that ribs are formed between the projecting ribs, extending perpendicularly to the latter on the bottom of the housing, these ribs terminating in two transverse webs extending in parallel to the transverse walls and serving for the guidance of the contact support, the contact support being guided between these transverse webs.

9. Switching device according to claim 7, characterized in that perforations and, respectively, recesses are provided as part of an interlocking connection in the sidewalls of the housing in the region of the switching space close to the top edge.

10. Switching device according to claim 7, characterized in that recesses are formed at the transition of the transverse walls to one sidewall, for inserting the switch space cover, and centering bores are formed on the opposite transition of the transverse walls to another sidewall in a thickened portion.

11. Switching device according to claim 7, characterized in that projecting webs are formed at the housing on the underside in the region of the sidewalls, these webs ensuring an adequate voltage interval to an adjoining switching device.

12. Switching device according to claim 7, characterized in that contact bases of the connecting contacts and of the coil terminals exhibit barb-like extensions by means of which the basis are retained in a force-derived and interlocking fashion in the connecting spaces of the housing.

13. Switching device according to claim 1, characterized in that the switch space cover exhibits a marginal web continuously extending along three sides and projecting upwardly beyond a cover, this marginal web being fashioned on its outside and/or inside with recesses and/or projections for the production of an interlocking connection.

14. Switching device according to claim 7, characterized in that the switch space cover is fashioned, on sides contacting the sidewalls of the housing, with undercut projections for clipping into corresponding recesses and/or perforations of the housing sidewalls.

15. Switching device according to claim 1, characterized in that the switch space cover has a coding unit on its topside.

16. Switching device according to claim 1, characterized in that the switch space cover exhibits, on its side facing the contact support, a projecting guide rib extending centrally in the switching direction (S), this guide rib engaging into a groove extending on a topside of the contact support.

17. Switching device according to claims 1 or 2, characterized in that all guide surfaces of the contact support oppositely to the switch space cover and/or the housing including grooves and webs, are located at the top part of the contact support.

18. Switching device according to claim 2, characterized in that the top part of the contact support exhibits walls which project downwardly past the inserted bottom part, the top part engaging with these walls in between the transverse webs on the housing bottom.

19. Switching device according to claim 2, characterized in that the top part of the contact support exhibits, on an end face, a recess for accommodating the return spring, extending below the position of the bridge contacts.

20. Switching device according to claim 1, characterized in that the insert means can be releasably clamped in place on the switch space cover by means of snap pins.

* * * * *